US005291817A

United States Patent [19]

Smith

[11] Patent Number: 5,291,817

[45] Date of Patent: Mar. 8, 1994

[54] ADJUSTABLE BARREL TUNING APPARATUS FOR USE WITH A WOODWIND MUSICAL INSTRUMENT

[75] Inventor: Gary Smith, 256 W. 5th Ave., Collegeville, Pa. 19426

[73] Assignees: Mobile Music, Inc., Horsham; Gary Smith, Collegeville; Joseph Stefano, Oreland, all of Pa.

[21] Appl. No.: 3,346

[22] Filed: Jan. 12, 1993

[51] Int. Cl.[5] ..... G10D 9/00

[52] U.S. Cl. ..... 84/386

[58] Field of Search ..... 84/386, 380 R, 381, 84/382, 384, 385 R, 380 A, 380 B, 380 C

[56] References Cited

U.S. PATENT DOCUMENTS

| | | | |
|---|---|---|---|
| 1,103,555 | 7/1914 | Alberti | 84/386 |
| 1,171,647 | 2/1916 | Reynolds | 84/386 |
| 1,194,887 | 8/1916 | Solberg | 84/386 |
| 1,361,629 | 12/1920 | Sinclair | 84/386 |
| 1,365,860 | 1/1921 | Sinclair | 84/386 |
| 1,374,758 | 4/1921 | Nenneker | 84/386 |
| 1,821,655 | 9/1931 | Loomis | 84/386 |
| 1,837,227 | 12/1931 | Loomis | 84/386 |
| 1,867,481 | 7/1932 | Todt | 84/386 |
| 1,870,211 | 8/1932 | Smith | 84/386 |
| 2,036,356 | 4/1936 | Pedler | 84/386 |
| 2,323,138 | 6/1943 | Kearns | 84/386 |
| 2,485,021 | 10/1949 | Strupe | 84/386 |
| 2,802,387 | 8/1957 | Bushnell | 84/386 |
| 2,943,526 | 7/1960 | Van Caster | 84/386 |
| 3,763,737 | 10/1973 | Sandner | 84/384 |
| 4,245,543 | 1/1981 | Werschnik | 84/386 |
| 4,258,605 | 3/1981 | Lorenzini | 84/386 |
| 4,320,686 | 3/1982 | Lewis | 84/386 |
| 4,430,920 | 2/1984 | Werschnik | 84/386 |
| 4,754,682 | 7/1988 | Getzen | 84/386 |
| 5,000,072 | 3/1991 | Pascucci | 84/386 |

*Primary Examiner*—Michael L. Gellner
*Assistant Examiner*—Cassandra C. Spyrou
*Attorney, Agent, or Firm*—Sperry, Zoda & Kane

[57] ABSTRACT

An apparatus for varying the length of the barrel of a woodwind musical instrument by providing adjustability in the length thereof which includes two tubular members which are telescopingly movable with respect to one another and include a primary gear rack mounted on the second tubular member and a rotatably movable adjustment wheel mounted on the first tubular member with a gear fixedly secured to the adjustment wheel and in engagement with respect to the teeth of the primary gear rack such that movement of the adjustment wheel will cause movement of the primary gear rack and relative movement between the first and second tubular member for adjusting or tuning of the length between the first and second tubular members. Each tubular member defines a bore extending centrally therealong which is coincident on the same longitudinally extending bore axis. A locking device is included for selectively fixedly securing the first and second tubular members with respect to one another as desired. Also a first longitudinal orientation device is positioned on the first tubular member and a second orientation device is positioned on the second tubular member to prevent relative rotational movement thereof to prevent rotational movement therebetween and allow only axial tuning movement therebetween. The longitudinal orientation means will preferably include a key and engaging key slot configuration defined on the two tubular members.

19 Claims, 5 Drawing Sheets

ADJUSTABLE BARREL TUNING APPARATUS FOR USE WITH A WOODWIND MUSICAL INSTRUMENT

BACKGROUND OF THE INVENTION

1. Field Of The Invention

The present invention deals with the field of devices for facilitating the tuning of woodwind instruments and in particular the tuning of the barrel of the clarinet. The total length of a clarinet has a distinct effect upon the tone thereof. Historically tuning was achieved by a user partially withdrawing of the instrument from the instrument receiving aperture in the barrel of a clarinet to achieve the proper tune thereof. This tuning can vary due to temperature or humidity conditions in the environment or in the instrument itself.

With such woodwind instruments, it is conventional that the mouthpiece is removable for replacement or for removal and replacement of a new reed. The mouthpiece normally merely slides into an aperture defined in the uppermost end of the barrel. The musicians have learned over the years to tune the clarinet or other woodwind instrument by varying the depth of engagement of the instrument with respect to the aperture defined in the barrel.

The present invention provides a means for achieving this tuning into a novel interrelationship of a rotatable wheel and a rack and two tubular members to allow repeatable and accurate tuning of the clarinet in a highly efficient and extremely quick manner.

2. Description Of The Prior Art

Prior art devices have been patented for facilitating the tuning of musical instruments such as U.S. Pat. No. 1,103,555 patented Jul. 14, 1914 to N. Alberti on a "Wood Wind Instrument"; and U.S. Pat. No. 1,171,647 patented Feb. 15, 1916 to W. F. Reynolds on a "Tuning Slide For Clarinets"; and U.S. Pat. No. 1,194,887 patented Aug. 15, 1916 to T. Solberg on a "Clarinet Tuning Slide"; and U.S. Pat. No. 1,361,629 patented Dec. 7, 1920 to A. J. Sinclair on a "Tuning Device For Wind Musical Instruments"; and U.S. Pat. No. 1,365,860 patented Jan. 18, 1921 to A. J. Sinclair on a "Tuning Device For Wind Musical Instruments"; and U.S. Pat. No. 1,374,758 patented Apr. 12, 1921 to G. F. Nenneker on a "Tuning Attachment For Wind Musical Instruments"; and U.S. Pat. No. 1,821,655 patented Sep. 1, 1931 to A. Loomis on a "Tuning Device For Wind Musical Instruments"; and U.S. Pat. No. 1,837,227 patented Dec. 22, 1931 to A. Loomis on a "Tuning Device For Musical Instruments"; and U.S. Pat. No. 1,867,481 patented Jul. 12, 1932 to E. B. Todt on a "Wind Musical Instrument"; and U.S. Pat. No. 1,870,211 patented Aug. 2, 1932 to A. L. Smith on a "Tuning Device For Wind Musical Instruments"; and U.S. Pat. No. 2,036,356 patented Apr. 7, 1936 to T. H. Pedler on a "Tuning Joint For Musical Instruments"; and U.S. Pat. No. 2,323,138 patented Jun. 29, 1943 to T. T. Kearns on a "Tuning Barrel For Wind Instruments"; and U.S. Pat. No. 2,485,021 patented Oct. 18, 1949 to C. H. Strupe on a "Tuning Device For Wind Musical Instruments"; and U.S. Pat. No. 2,802,387 patented Aug. 13, 1957 to F. J. Bushnell on a "Tuning Device For Musical Instruments"; and U.S. Pat. No. 2,943,526 patented Jul. 5, 1960 to B. L. Van Caster on a "Detachable Union And Tuning Joint For Musical Instruments"; and U.S. Pat. No. 4,245,543 patented Jan. 20, 1981 to A. Werschnik on a "Clarinet With Varying Diameter Of Its Longitudinal Bore"; and U.S. Pat. No. 4,258,605 patented Mar. 31, 1981 to R. Lorenzini on a "Clarinet Barrel With Removable Throat"; and U.S. Pat. No. 4,320,686 patented Mar. 23, 1982 to J. Lewis on a "Wind Instrument With Continuously Variable Pitch Control"; and U.S. Pat. No. 4,430,920 patented Feb. 14, 1984 to A. Werschnik on a "Clarinet Bore Having Varying Diameters"; and U.S. Pat. No. 4,754,682 patented Jul. 5, 1988 to D. Getzen on a "Clarinet Tuning Barrel"; and U.S. Pat. No. 5,000,072 patented Mar. 19, 1991 to V. Pascussi on an "Apparatus For Locating Sections Of A Wind Instrument".

SUMMARY OF THE INVENTION

The present invention provides a novel apparatus to facilitate adjusting the barrel of a woodwind instrument such as a clarinet which includes a first tubular member having a first bore defined extending longitudinally and axially therethrough. This first tubular member also includes a first bore upper end and a first bore lower end defining the opposite ends of the given bore. The first tubular member preferably comprises an upper tubular member.

The apparatus further includes a second tubular member which defines a second bore therein extending axially and longitudinally therealong which defines a second bore upper end and a second bore lower end therein. This second tubular member is preferably in movable engagement with respect to the first tubular member in such a manner as to be telescopingly slidable with respect thereto. With this configuration the first and second bores are registered with respect to one another, that is, they are oriented with the longitudinally extending axes thereof being coincident. The second tubular member preferably comprises a lower or intermediate tubular member to be in telescopingly movable engagement with respect to the upper tubular member or first tubular member. By varying the telescopingly slidable movement between the upper and lower tubular members adjustment in positioning or the total distance between the first bore upper end and the second bore lower end can be accurately controlled to thereby facilitate specific tuning of the woodwind instrument with which the adjustable barrel tuning apparatus is utilized.

With the configuration of the present invention a primary gear rack is preferably fixedly secured to the second tubular member and extends longitudinally therealong. Also an adjustment wheel is included rotatably mounted on the first tubular member. This adjustment wheel preferably includes two adjustment wheel members rotatably mounted on the first tubular member. The adjustment wheel further includes a gear member fixedly secured between the two adjustment wheel members and positioned in engagement with respect to the teeth of the primary gear rack. This adjustment wheel is responsive to rotational movement thereof to urge telescoping movement of the first tubular member axially and longitudinally with respect to the second tubular member to provide adjustability and tuning for a woodwind musical instrument such as a clarinet by varying of the distance between the first bore upper end and the second bore lower end.

A locking means is preferably included positioned between the first tubular member and the second tubular member which is adapted to be detachably secure the first tubular member with respect to the second tubular member as desired to restrict relative movement therebetween and hold the fully tuned positioned when adjusted to the proper position.

A first longitudinal orientation device such as a key member is fixedly attached with respect to the first tubular member and extends longitudinally therealong. Preferably two such key members will comprise this first longitudinal orientation device each of which will extend longitudinally along the first tubular member. A second longitudinal orientation device such as two key slots will be defined in the second tubular member. These key slots will be configured to receive the two key members of the first longitudinal orientation means in such a manner as to be engaged therewith and restrict rotational movement of the first tubular member with respect to the second tubular member.

The present invention may further include a tactile indicator means which is movably secured to the first tubular member and extends outwardly therefrom into abutting contact with respect to the primary gear rack and is adapted to provide an audible and tactile indication of increments of relative movement between the first tubular member and the second tubular member. This tactile indicator device will preferably include a biasing means for urging the tactile indicator device into abutting contact with respect to the teeth of the primary gear rack thereby providing a means for generation of the audible and tactile indication of relative movement between the first and second tubular members.

The present invention may further include an extension limit device to restrict the maximum extent of movement of the first tubular member with respect to the second tubular member. This extension limit device preferably includes a locking shoulder located on the first tubular member adapted to engage a stepped slot defined in the second tubular member. The stepped slot is configured of the proper size to receive the locking shoulder extending therein when the first tubular member is moved to the maximum extended position with respect to the second tubular member to restrict over extension therebetween.

The present invention further includes distance reference indicia positioned on the second tubular member adjacent the key member of the first tubular member to indicate the spatial distance between the first upper bore end and the second lower bore end and thereby provide a direct readout as to the position of the first and second tubular members with respect to one another to facilitate repetitive positioning and adjustability as desired.

The locking means of the present invention may comprise a locking slot defined between the first tubular member and the second tubular member and extending longitudinally therealong. The first tubular member when used with this locking slot will preferably be angularly tapered adjacent the locking slot. A locking slide member may also be defined movably positioned within this locking slot such as to be slidable between a locked position wedged into simultaneous abutting contact with the first and second tubular members and an unlocked position allowing relative movement between the first tubular member and the second tubular member. This locking slide member is preferably slidable to a position adjacent the first tubular member adjacent the angular tapered section thereof to facilitate wedging into the locked position as desired. In an alternative configuration the locking configuration can comprise a pawl member pivotally mounted on the first tubular member and engageable with respect to the secondary gear rack to selectively restrict movement of the first tubular member with respect to the second tubular member. This pawl member preferably includes a pivot arm movably mounted on the first tubular member to be pivotable with respect thereto. This pivot arm includes a first pivot arm section and a second pivot arm section. The second pivot arm section is engageable with respect to the second gear rack to restrict movement of the first tubular member with respect to the second tubular member. The second pivot arm section is preferably flexibly resilient to facilitate engagement and release from engagement with respect to the secondary gear rack. A specific gear engagement means is mounted on the second pivot arm. This gear engagement means is positionable adjacent the teeth of the secondary gear rack for selective engagement therewith to restrict relative movement between the first and second tubular members. This gear engagement means can simply comprise a plurality of teeth on the second pivot arm section positioned to engage the teeth of the secondary gear rack. Alternatively the gear engagement device can be a separate member pivotally movable with respect to the pivot arm to facilitate engagement and release with respect to the teeth of the secondary gear rack.

In either case the pawl means will further include a release tab positioned on the first arm section which is responsive to force being exerted thereagainst to pivot the pivot arm and move the gear engagement means out of engagement with respect to the secondary gear rack and allow longitudinal axial movement of the first tubular member with respect to the second tubular member.

This alternative configuration of the locking device will further include a pawl biasing means such as a spring positioned between the pawl and the first tubular member which is adapted to urge the gear engagement means mounted on the pivot arm of the pawl into engagement with respect to a secondary gear rack.

It is an object of the present invention to provide an adjustable barrel tuning apparatus for use with a woodwind musical instrument such as a clarinet wherein the total number of moving parts is minimized.

It is an object of the present invention to provide an adjustable barrel tuning apparatus for use with a woodwind musical instrument such as a clarinet wherein reliability and efficiency in tuning is achieved.

It is an object of the present invention to provide an adjustable barrel tuning apparatus for use with a woodwind musical instrument such as a clarinet wherein change in pitch can be achieved merely by rotating a vertically extending adjusting wheel.

It is an object of the present invention to provide an adjustable barrel tuning apparatus for use with a woodwind musical instrument such as a clarinet wherein use with respect to all different types of clarinets as well as many different types of musical instruments is possible.

It is an object of the present invention to provide an adjustable barrel tuning apparatus for use with a woodwind musical instrument such as a clarinet wherein tuning to any specific pitch can be achieved quickly and efficiently.

It is an object of the present invention to provide an adjustable barrel tuning apparatus for use with a woodwind musical instrument such as a clarinet wherein tuning is easy to vary as desired.

It is an object of the present invention to provide an adjustable barrel tuning apparatus for use with a woodwind musical instrument such as a clarinet wherein the barrel length is fully adjustable between approximately 60 and 70 millimeters in total longitudinal or axial dimension.

It is an object of the present invention to provide an adjustable barrel tuning apparatus for use with a woodwind musical instrument such as a clarinet wherein the apparatus itself is impervious to temperature changes.

It is an object of the present invention to provide an adjustable barrel tuning apparatus for use with a woodwind musical instrument such as a clarinet wherein repetitive tuning to the same position is easily achievable.

It is an object of the present invention to provide an adjustable barrel tuning apparatus for use with a woodwind musical instrument such as a clarinet wherein locking in a specifically tuned position is made very easy and quick.

It is an object of the present invention to provide an adjustable barrel tuning apparatus for use with a woodwind musical instrument such as a clarinet wherein the apparatus is reliable and is virtually maintenance free.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 3:
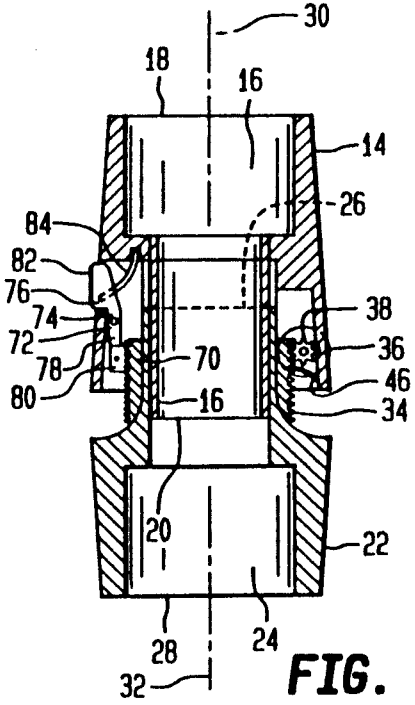
FIG. 3 is an illustration of the embodiment shown in FIG. 1 with the locking means in the locked position and the first and second tubular members in the fully extended position.
Figure 2:
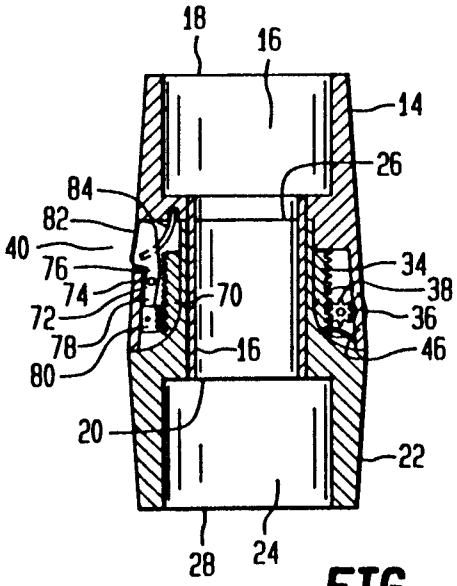
FIG. 2 is an illustration of the embodiment shown in FIG. 1 with the locking means in the released position.
Figure 4:
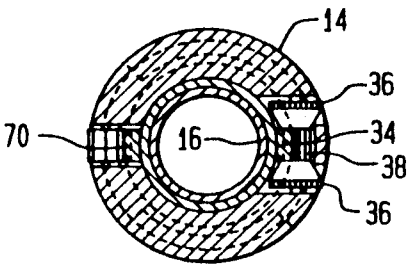
FIG. 4 is a cross-sectional view of the embodiment shown in FIG. 1 along lines 4—4.
Figure 1:
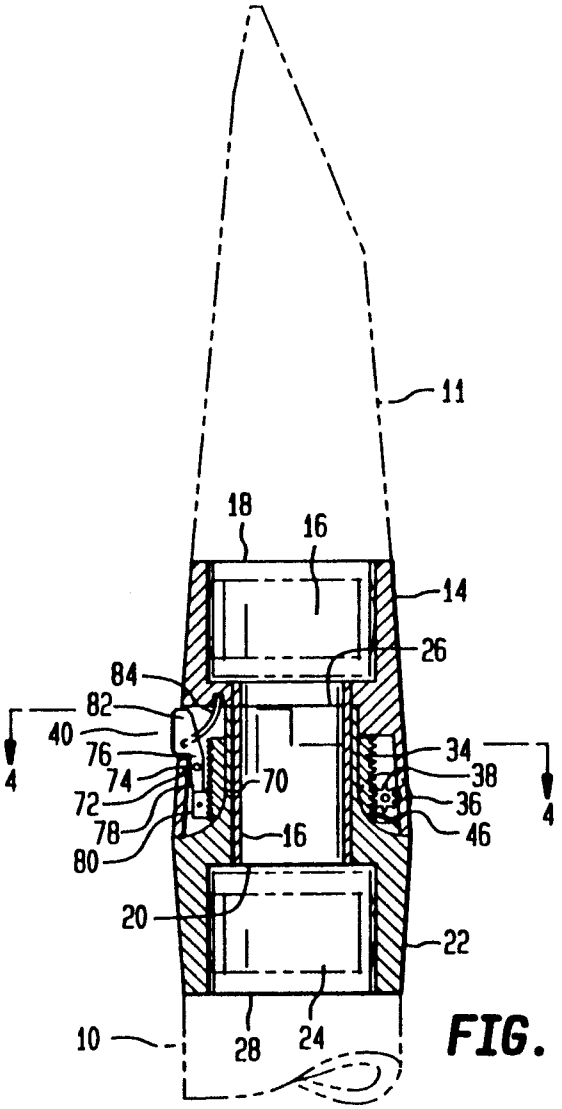
FIG. 1 is a front cross-sectional view of an embodiment of the adjustable barrel tuning apparatus of the present invention shown locked in the fully retracted position attached to a woodwind musical instrument.
Figure 5B:
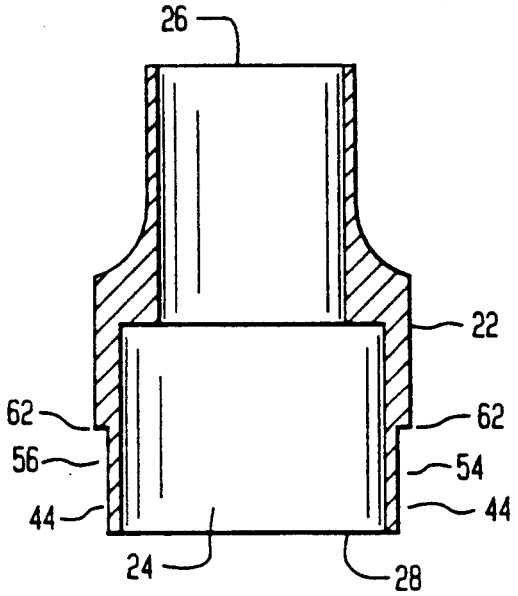
FIG. 5*b* is a side cross-sectional view of the embodiment of the second tubular member of the present invention.
Figure 6B:
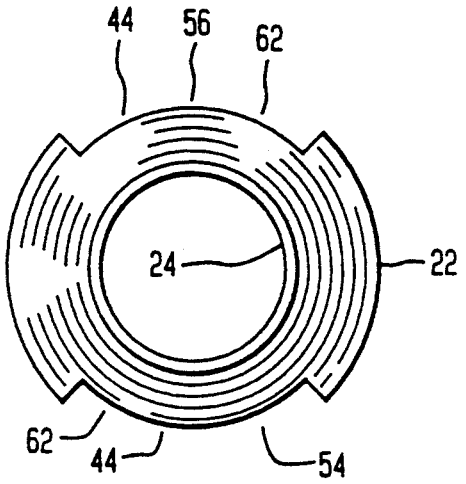
FIG. 6*b* is a top plan view of the embodiment shown in FIG. 5.
Figure 5A:
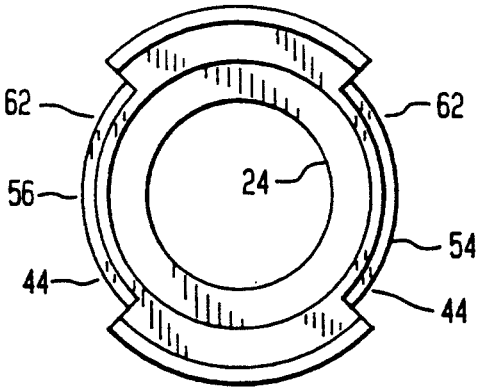
FIG. 5*a* is a bottom plan view of an embodiment of the second tubular member of the present invention.
Figure 6A:
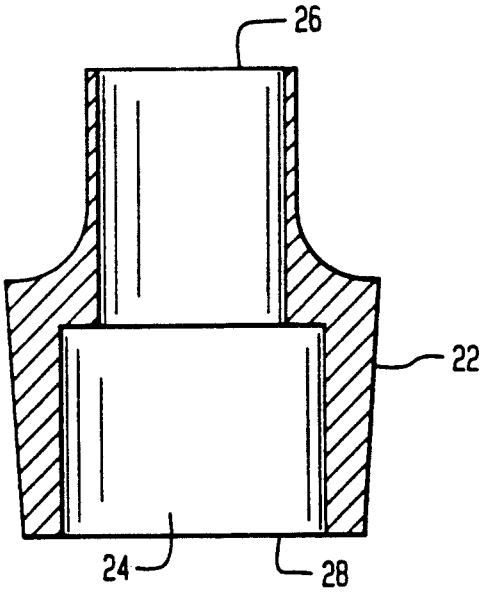
FIG. 6*a* is a front cross-sectional view of the embodiment shown in FIG. 5.
Figure 7A:
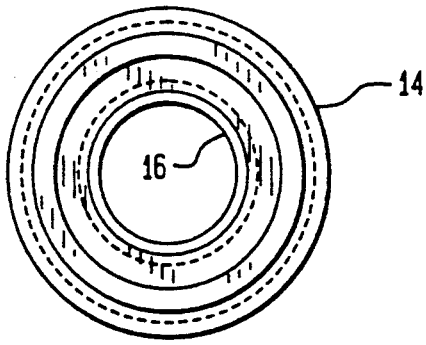
FIG. 7*a* is a top cross-sectional view of an embodiment of the first tubular member.
Figure 7B:
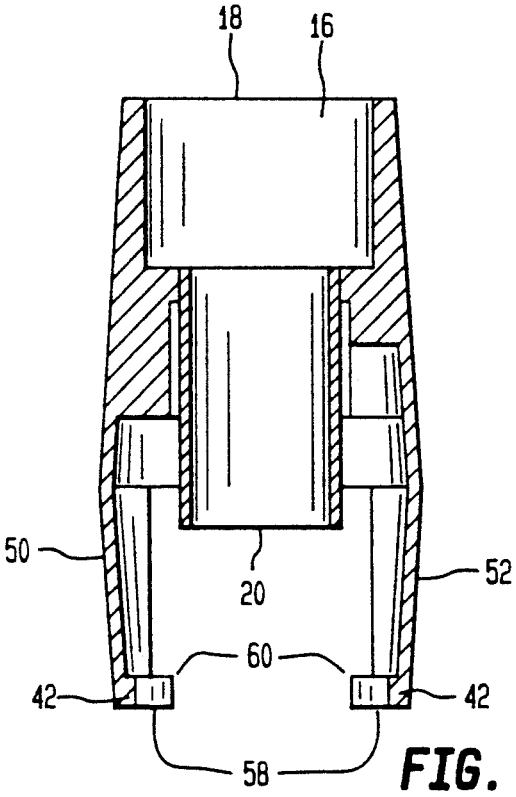
FIG. 7*b* is a side cross-sectional view of an embodiment of the first tubular member.
Figure 7C:
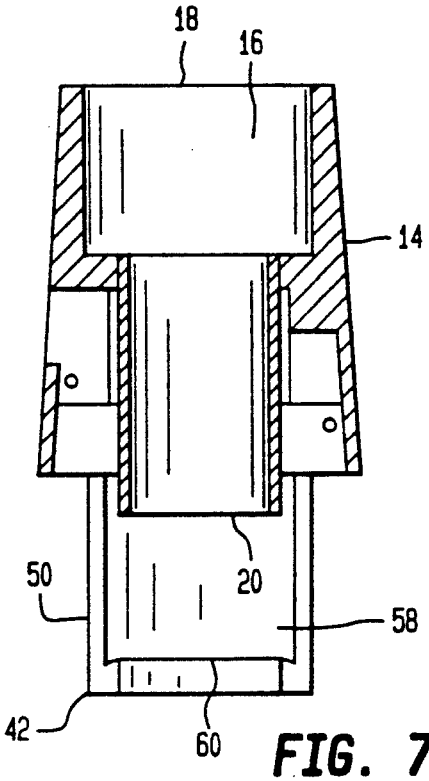
FIG. 7*c* is a front cross-sectional view of an embodiment of the first tubular member.
Figure 7D:
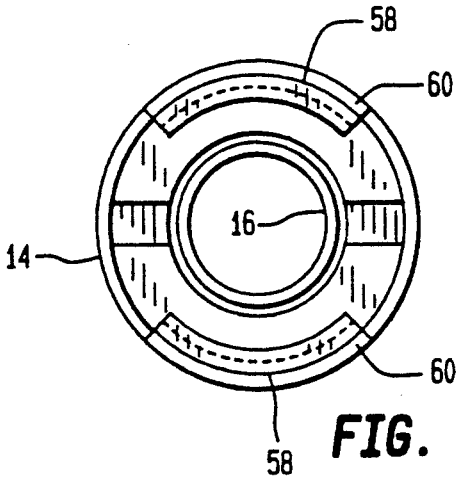
FIG. 7*d* is a bottom cross-sectional view of an embodiment of the first tubular member.
Figure 8:
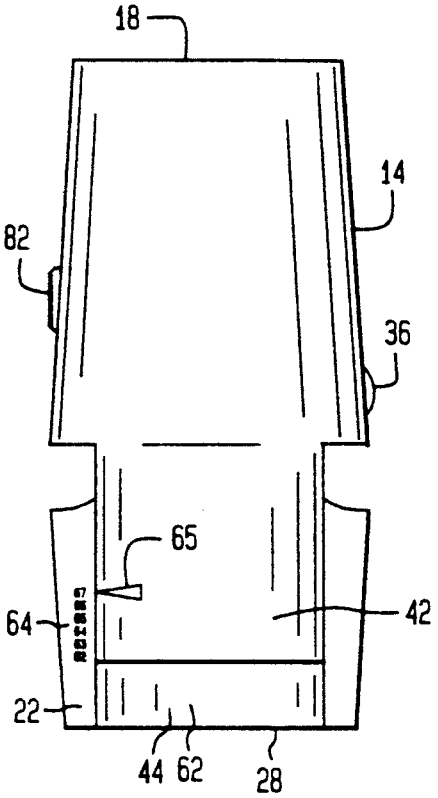
FIG. 8 is a front plan view of an embodiment of the adjustable barrel tuning apparatus of the present invention shown in the fully extended position with the indicia included thereon.
Figure 9:
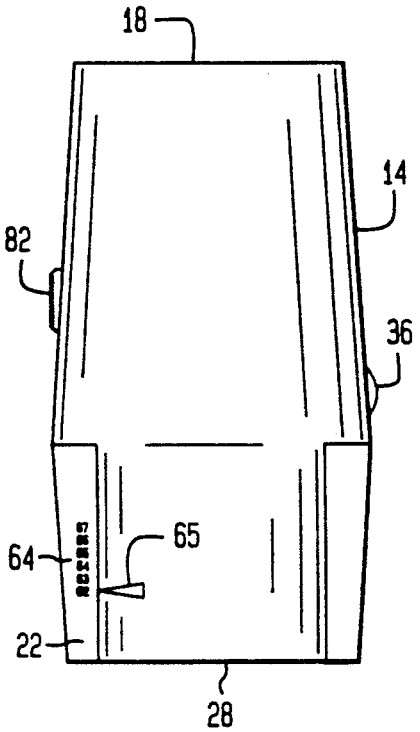
FIG. 9 is an illustration of the embodiment shown in FIG. 8 in the fully retracted position.
Figure 10A:
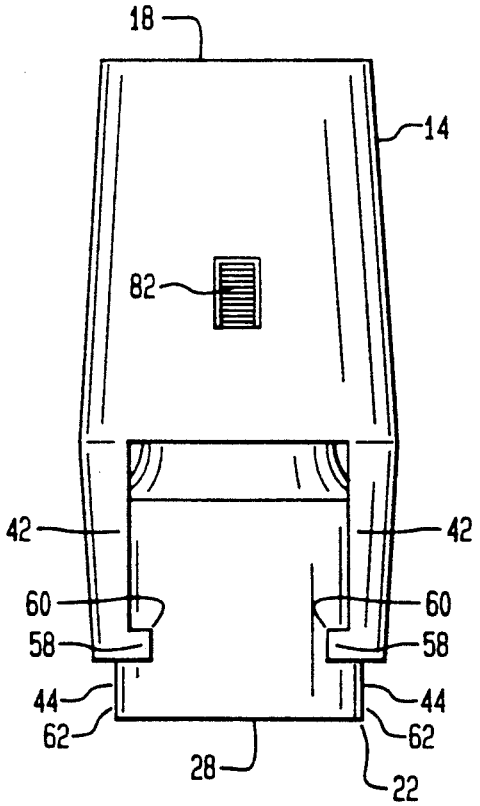
FIG. 10*a* is a side plan view of the embodiment shown in FIG. 8 as seen from the left side.
Figure 10B:
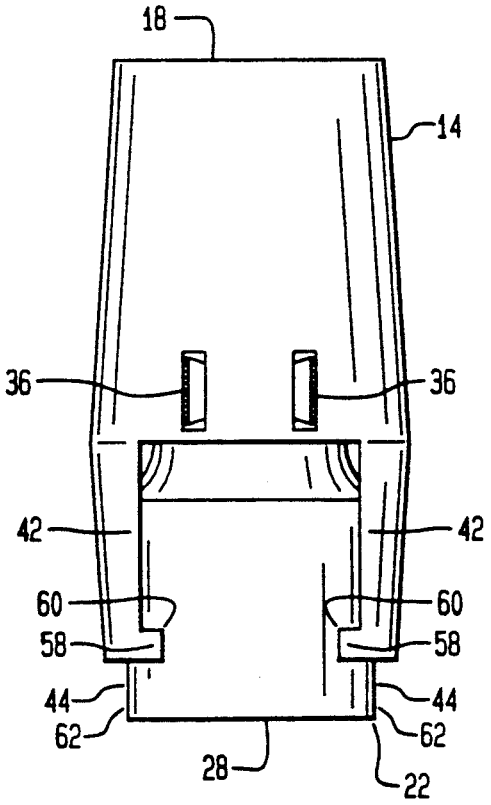
FIG. 10*b* is a side plan view of the embodiment shown in FIG. 8 as seen from the right side.
Figure 11:
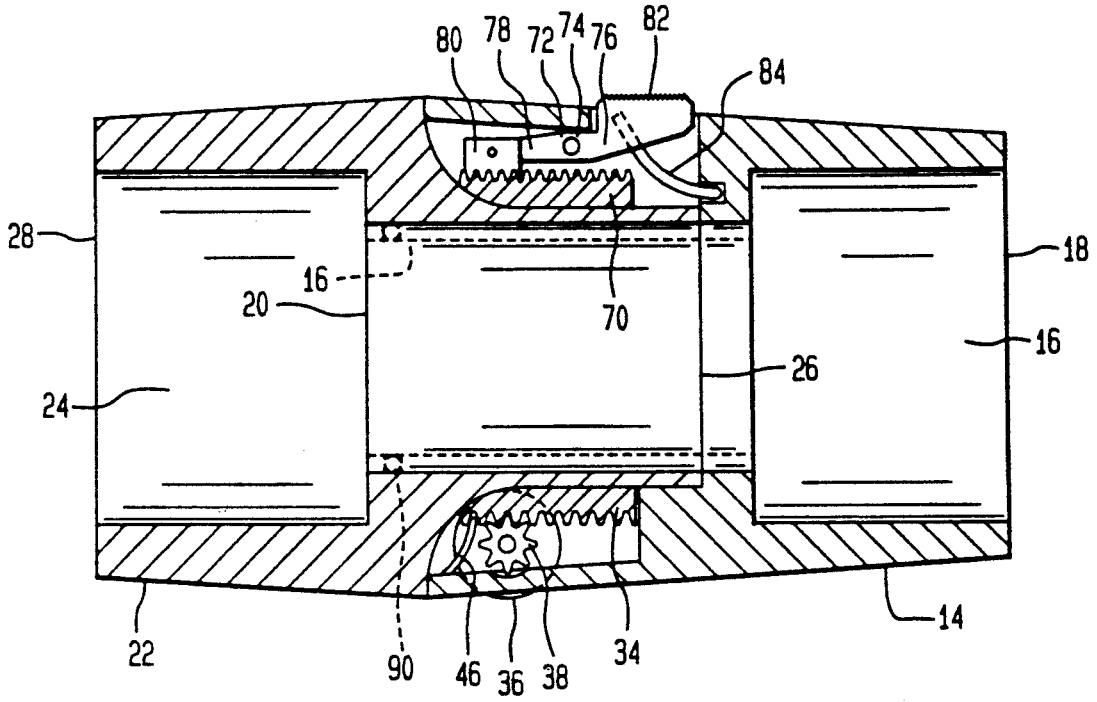
FIG. 11 is a front cross-sectional view of an alternative embodiment of the present invention showing the flexible resilient second pawl section in the locking means shown in the locked and fully retracted position.
Figure 12:
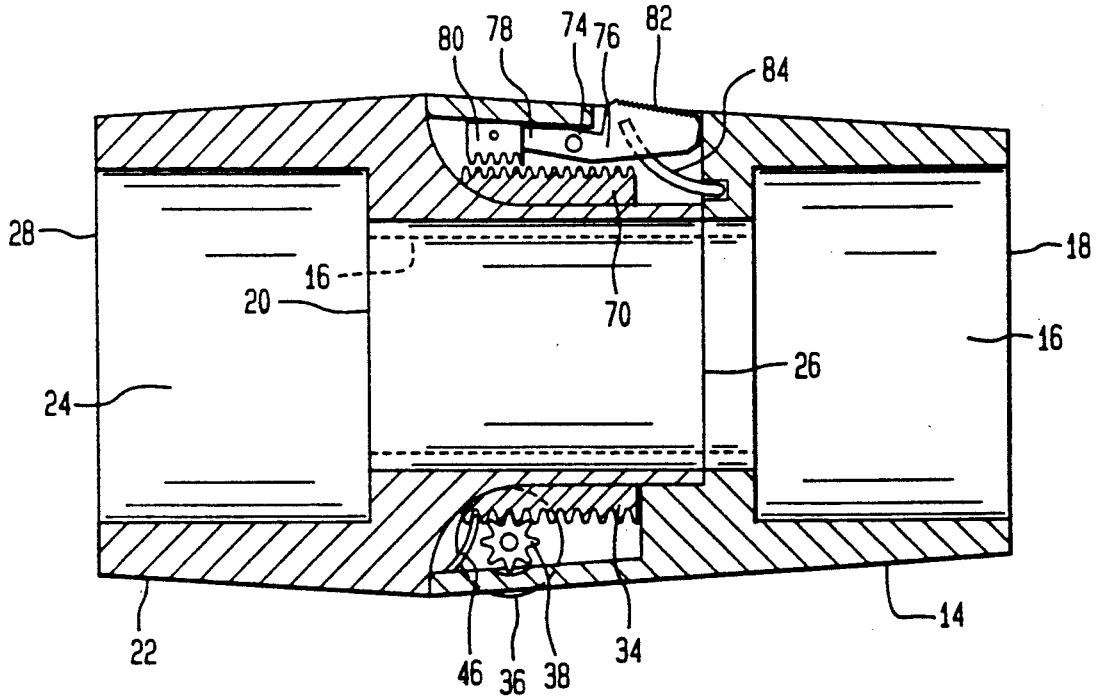
FIG. 12 is a front cross-sectional view of an illustration of the embodiment shown in FIG. 11 in the unlocked position.

The present invention provides an adjustable barrel tuning apparatus for use with a woodwind musical instrument 10 such as a clarinet. Normally with such an instrument tuning can be achieved by varying the extent of engagement between the mouthpiece 11 and the upper joint 12 of the instrument 10. The present invention provide a means for accurately and repetitively positioning these parts for specific tuning as desired. In particular, the present invention includes a first tubular member 14 which preferably is configured as an upper tubular member which defines a first bore means 16 extending therealong with a first bore upper end 18 at the upper end of the first tubular member 14 and a first bore lower end 20 at the lower end of the first tubular member 14. The bore means 16 extending from the upper end 18 to the lower end 20 thereof is adapted to be registration with respect to a similar second bore means 24 defined in a second tubular member 22 positioned thereadjacent.

Preferably the second tubular member 22 comprises a lower tubular member and defines the second bore means 24 extending longitudinally therethrough between the second bore upper end 26 and a second bore lower end 28. The first tubular member 14 which is preferably an upper tubular member is engageable with respect to the second tubular member 22 which is preferably a lower tubular member in such a manner as to be telescopingly movable with respect to one another.

The first tubular member 14 and the second tubular member 22 are oriented with the axis of the first bore means 30 coincident with the axis of the second bore means 32. By positioning of the first bore 16 and the second bore 24 extending through the first tubular member 14 and the second tubular member 22 in registration with respect to one another the respect axes 30 and 32 will be coincident.

Preferably a primary gear rack 34 will be fixedly secured with respect to the outer portion of the second tubular member 22. An adjustable wheel means 36 which may comprise two individual wheel members is rotatably mounted with respect to the first tubular member 14. A gear 38 is adapted to be fixedly secured with respect to the adjustment wheel 36. Preferably gear 38 is positioned between the two individual adjustment wheels 36 in such a manner as to be fixedly secured therebetween. The gear teeth of gear means 38 are preferably positioned in engagement with respect to the teeth of the primary gear rack 34. With this configuration rotation of the adjustment wheels 36 will urge movement of the primary gear rack 34 with respect thereto resulting in relative telescoping movement between the first tubular member 14 and the second tubular member 22. This movement provides a means for adjustment and tuning of the adjustable barrel of the present invention.

To facilitate positioning of the first and second tubular member with respect to one another the present invention may include a locking means 40 to selectively affix the position of the first tubular member 14 with respect to the second tubular member 22 as desired to hold a specific tuned position. This locking means can take several configurations which will be described herebelow.

The present invention may further include a first longitudinal orientation means 42 positioned on the first tubular member 14 such as a first key member 50 and a second key member 52. The second tubular member 22 will include a second longitudinal orientation means 44 positioned thereon which preferably comprise a first key slot 54 and a second key slot 56. With this specific key and key slot configuration of the first and second longitudinal orientation means 42 and 44 the first key slot 54 will be configured and sized to readily receive the first key member 50 extending therein. Similarly the second key slot 56 will be configured and sized such as to receive the second key member 52 therein. The key and key slot configuration of the first longitudinal orientation means 42 and the second longitudinal orientation means 44 will prevent rotational movement of the first tubular member 14 with respect to the second tubular member 22 and yet will allow axial or longitudinal movement therebetween.

The present invention may also include a tactile indicator means 46 such as a flexible arm or other similar configuration and will include an indicator biasing means 48 for urging of the indicator 46 into abutment with respect to the teeth of the gear 38 or the primary gear rack 34. This tactile indicator means 46 is adapted to provide tactile and audible indication of movement of the first tubular member 14 with respect to the second tubular member 22 through a given incremental distance equal to the spacing between the individual teeth on the gear 38 or the primary gear rack 34.

The present invention further includes an extension limit means 58 which comprises locking shoulders 60 located on the first tubular member 14 and a stepped slot 62 defined on the second tubular member 22. The stepped slot 62 is adapted to receive the locking shoulder 60 therein responsive to the key member 50 of the first tubular member 14 being moved within the key slot 54 defined in the second tubular member 22 to the fully extended position with the bore upper end 18 being positioned at the maximum possible distance from the second bore lower end 28. In this fully extended position it is desired to provide a means for preventing any further movement of the first and second tubular members 14 and 22 with respect to one another and therefore this extension limit means 58 achieved by interconnection between the locking shoulder 60 and the stepped slot 62 prevents any such further extension movement.

The present invention further includes a plurality of distance reference indicia 64 noted as markings on the side of the second tubular member 22 immediately adjacent to the key member 42 of the first tubular member 14 and an indicator mark 65 on the side of the first tubular member. In this manner the distance reference indicia 64 will indicate the spatial distance between the first bore upper end 18 and the second bore lower end 28 and facilitate adjustment therebetween for tuning. As the first tubular member 14 is moved away from second tubular member 22 the lowermost edge of the indicator mark 65 of the key member 50 or 52 will move along the indicia extending upwardly adjacent the first or second key slots 54 and 56 in such a manner as to give a visual indication of the tuning position of the apparatus.

The locking means 40 of the present invention may include a locking slot 66 defined between the first tubular member 14 and the second tubular member 22. The slot between these two parts can be tapered due to a tapered portion or surface on the first tubular member 14. A locking slide member 68 is preferably positioned within this locking slot 66 and when moved upwardly into engagement with the tapered surface of the first tubular member 14 will be wedged between the first tubular member 14 and the second tubular member 22 in such a fashion as to lock those two tubular members in respect to one another and prevent movement in either direction. If it is desired to release the lock the slide member 68 can be moved downwardly out of engagement with respect to the tapered portion of the first tubular member 14 and thereby again allow relative movement between first tubular member 14 and second tubular member 22.

In an alternative configuration of the locking means 40 of the present invention a secondary gear rack 70 may be fixedly secured with respect to the second tubular member 22 at a position somewhat removed from the position of the primary gear rack means 34. Normally secondary gear rack 70 will be located angularly at approximately 180 degrees from the location of the primary gear means 34. A pawl means 72 can be pivotally secured with respect to the first tubular member 14. Pawl means 72 preferably includes a pivot arm means 74 which itself is pivotally secured with respect to the first tubular member 14 and defines a first pivot arm section 76 on one side of the pivot location of the pivot arm means 74 and a second pivot arm section 78 on the opposite side of the pivot point of pivot arm means 74.

First pivot arm section 76 preferably includes a release tab means 82 thereon to facilitate release of this alternative configuration of the locking means 40. The second pivot arm section 78 will include a gear engagement means 80 thereon which includes teeth thereon which are adapted to engage the teeth of the secondary gear rack 70 selectively as desired. A pawl biasing means such as a spring means 84 of any conventional spring configuration may also be included positioned between the first tubular member 14 and the pawl means 72. Pawl biasing spring means 84 is adapted to bias the gear engagement means 80 toward engagement with respect to the teeth of the secondary gear rack 70.

With the gear engagement means 80 in engagement with respect to the teeth of the secondary gear rack 70 the first tubular member 14 will be locked to prevent movement thereof relative to the second tubular member 22. Release of the gear engagement means 80 from the locking position is achieved by exerting force against the release tab 82. This force against abutment or tab 82 will cause pivoting of the pivot arm 74 with respect to the first tubular member 14 and will disengage the gear engagement means 80 from the secondary gear rack 70. Due to the pivotal connection of the second pivot arm section 78 with respect to the first tubular member 14 this disengaging movement of the gear engagement means 80 from the secondary gear rack 70 will be somewhat non-uniform. That is, due to the pivotal nature of the movement of the second pivot arm section 78 away from the secondary gear rack 70 the teeth on the outermost portion of the second pivot arm section 78 will disengage prior to the teeth closer to the point of pivot arm 74. If necessary due to dimensional clearance limitations, this type of rotational movement to remove two linear sets of gear teeth from one another is preferably overcome by one of several configurations disclosed in the present invention.

If the gear engagement means 80 is pivotally attached to the second pivot arm section 78 then as the lower or outermost edge of the gear engagement means 80 contacts the inside of the outer wall of tubular member 14, it will cause rotating of the gear engagement means 80 back to a more linear alignment with respect to the teeth of the secondary gear rack 70. To enhance the maintenance of the gear teeth linear with respect to one another the second pivot arm section 78 can be formed of a flexibly resilient material to allow some flexing thereof during engagement and disengagement of the gear engagement means 80 with respect to the secondary gear rack 70. This flexibility will perform as would a pin jointed pivot to aid in maintaining of these gears linear with respect to one another as described hereinafter.

Alternatively the gear engagement means 80 of the second pivot arm section 78 can comprise a completely separate pivotal piece. The gear engagement means 80 can include a plate having a plurality of engaging teeth thereon wherein the plate itself is pivotally mounted to a position along the second pivot arm section 78. By allowing freedom of rotational movement of the teeth of the gear engagement means 80 with respect to the second pivot arm section 78 the teeth will automatically be maintained linearly with respect to the teeth of the secondary gear rack 70.

The flat spring 84 can be chosen to be mounted in an upper wall of the first tubular member 14 and be positioned adjacent the first pivot arm section 76 of the pivot arm 74 in such a manner as to selectively engage the inner portion of the upper pivot arm 76. Alternatively the flat spring 84 can be positioned in the first pivot arm section 76 and be selectively engageable with respect to an upper wall of the first tubular member 14 to, also, in a similar manner, urge engagement of the gear engagement means 80 with respect to the secondary gear rack 70. Either of these chosen locations for positioning of the pawl biasing means 84 such as a flat spring means will accomplish a similar purpose by urging pivotal movement of the gear engagement means 80 toward the secondary gear rack 70.

The first and second key members 50 and 52 are adapted to be positioned within the first and second key slots 54 and 56, respectively. The longitudinal orientation of these keys 50 and 52 with respect to the key slots 54 and 56 are primarily included in order to maintain torsional resistance to rotation of the first tubular member 14 and second tubular member 22 with respect to one another. This is to prevent damage or relative twisting motion between two barrels if for some reason a twisting force is exerted thereon either during assembly to the clarinet or when the mouthpiece is placed therein. The second function of this key and key slot configuration is to restrict the extension of movement of the first tubular member 14 with respect to the second tubular member 22. To achieve this purpose extension limit means 58 includes the locking shoulder 60 on the first tubular member 14 and the stepped slot means 62 on the second tubular member 22. Additionally the key members 50 and 52 are mated to the key slots 54 and 56 in order to facilitate the placement of the distance reference indicia 64 on the second tubular member 22 to facilitate viewing thereof as the first tubular member 14 moves along with the indicator mark 65. It will be alternatively possible to position the indicia on the first tubular member 14 which is adapted to be moved in relation to a marking point defined on the second tubular member 22. Either configuration will work equally well to provide distance reference indicia 64.

To further facilitate sealing engagement between first tubular member 14 and second tubular member 22, an O-ring means 90 may be positioned therebetween. More than one individual O-ring may be required to effectively form a seal depending upon manufacturing tolerances.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An adjustable barrel tuning apparatus for use with a woodwind musical instrument comprising:

A. a first tubular member defining a first bore extending longitudinally and axially therethrough, said first tubular member defining a first bore upper end and a first bore lower end thereon;

B. a second tubular member defining a second bore extending longitudinally and axially therethrough, said second tubular member being in movable engagement with said first tubular member to be telescopingly slidable with respect thereto, said first bore and said second bore being oriented with the longitudinally extending axes thereof being coincident, said second tubular member defining a second bore upper end and a second bore lower end thereon;

C. a primary gear rack fixedly secured to said second tubular member and extending longitudinally therealong;

D. an adjustment wheel rotatably mounted on said first tubular member, said adjustment wheel including a gear fixedly secured thereto and positioned in engagement with said primary gear rack, said adjustment wheel being responsive to rotational movement thereof to urge telescoping movement of said first tubular member axially and longitudinally with respect to said second tubular member to provide adjustability in tuning for a woodwind musical instrument by varying the spatial relationship between said first bore upper end and said second bore lower end;

E. a locking means positioned between said first tubular member and said second tubular member and adapted to detachably secure said first tubular member to said second tubular member to restrict relative movement therebetween;

F. a first longitudinal orientation device fixedly attached to said first tubular member, said first longitudinal orientation device including at least one key member extending longitudinally along said first tubular member; and G. a second longitudinal orientation device fixedly attached to said second tubular member and in engagement with said first longitudinal orientation device to restrict relative rotational movement between said first tubular member and said second tubular member, said second longitudinal orientation device including at least one key slot extending longitudinally along said second tubular member, said key member and said key slot being engageable to one another to restrict relative rotational movement of said first tubular member with respect to said second tubular member.

2. An adjustable barrel tuning apparatus for use with a woodwind musical instrument as defined in claim 1 wherein said adjustment wheel comprises two adjustment wheel members rotatably mounted with respect to said first tubular member with said gear fixedly secured therebetween.

3. An adjustable barrel tuning apparatus for use with a woodwind musical instrument as defined in claim 1 further comprising a tactile indicator movably secured to said first tubular member and extending outwardly therefrom into abutting contact with said gear and being adapted to provide audible indication of increments of movement of said first tubular member with respect to said second tubular member, said tactile indicator including an indicator biasing means urging said tactile indicator into abutting contact with said gear.

4. An adjustable barrel tuning apparatus for use with a woodwind musical instrument as defined in claim 1 wherein said at least one key member includes two key members and wherein said at least one key slots includes two key slots defined therein being slidably engageable with respect to said two key members.

5. An adjustable barrel tuning apparatus for use with a woodwind musical instrument as defined in claim 1 further comprising an extension limit means comprising:

A. a locking shoulder located on said first tubular member; and

B. a stepped slot defined in said second tubular member and adapted to receive said locking shoulder therein responsive to said key member of said first tubular member being moved within said key slot defined in said second tubular member to the fully extended position with said first bore upper end being positioned at the maximum required distance from said second bore lower end.

6. An adjustable barrel tuning apparatus for use with a woodwind musical instrument as defined in claim 1 further comprising distance reference indicia positioned on said second tubular member adjacent said key member of said first tubular member to indicate the spatial distance between said first bore upper end of said first tubular member and said second bore lower end of said second tubular member and facilitate adjustment therebetween.

7. An adjustable barrel tuning apparatus for use with a woodwind musical instrument as defined in claim 1 wherein said locking means comprises:

A. a locking slot defined between said first tubular member and said second tubular member; and B. a locking slide member movably positioned within said locking slot and being slidable between a locking position wedged into simultaneous abutting contact with said first tubular member and said second tubular member and an unlocked positioned allowing relative movement between said first tubular member and said second tubular member.

8. An adjustable barrel tuning apparatus for use with a woodwind musical instrument as defined in claim 7 wherein said first tubular member is angularly tapered adjacent said locking slot defined therein to facilitate wedging of said locking slide member into simultaneous abutting contact with said first tubular member and said second tubular member responsive to said locking slide member being in the locked position.

9. An adjustable barrel tuning apparatus for use with a woodwind musical instrument as defined in claim 7 wherein said locking slot extends longitudinally between said first tubular member and said second tubular member and wherein said locking slide member is longitudinally slidable therewithin.

10. An adjustable barrel tuning apparatus for use with a woodwind musical instrument as defined in claim 1 wherein said locking means comprises:

A. a secondary gear rack fixedly secured to said second tubular member to be moveable therewith;

B. a pawl pivotally mounted on said first tubular member and being engageable with said secondary gear rack to selectively restrict movement of said first tubular member with respect to said second tubular member, said pawl comprising:

(1) a pivot arm movably mounted on said first tubular member to be pivotable with respect thereto, said pivot arm including a first pivot arm section and a second pivot arm section, said second pivot arm section being engageable with said secondary gear rack to restrict movement of said first tubular member with respect to said second tubular member;

(2) a gear engagement means mounted on said second pivot arm section, said gear engagement means being positionable adjacent said secondary gear rack for selective engagement therewith to restrict movement of said first tubular member with respect to said second tubular member; and (3) a release tab positioned on said fist pivot arm section and being responsive to force being exerted thereagainst to pivot said pivot arm to move said gear engagement means out of engagement with said secondary gear rack and allow longitudinal axial movement of said first tubular member with respect to said second tubular member.

11. An adjustable barrel tuning apparatus for use with a woodwind musical instrument as defined in claim 10 further comprising a pawl biasing means attached to said pawl and said first tubular member and being adapted to urge said gear engagement means on said second pivot arm section of said pawl into engagement with said secondary gear rack.

12. An adjustable barrel tuning apparatus for use with a woodwind musical instrument as defined in claim 11 wherein said pawl biasing means comprises a flat spring positioned between said gear engagement means of said pawl and said first tubular member.

13. An adjustable barrel tuning apparatus for use with a woodwind musical instrument as defined in claim 12 wherein said flat spring is attached to said first tubular member and is responsive to abutment with said gear engagement means for urging thereof toward said secondary gear rack to facilitate engagement therewith.

14. An adjustable barrel tuning apparatus for use with a woodwind musical instrument as defined in claim 12 wherein said flat spring is attached to said gear engagement means and is responsive to abutment with said first tubular member for urging of said gear engagement means toward said secondary gear rack to facilitate engagement therewith.

15. An adjustable barrel tuning apparatus for use with a woodwind musical instrument as defined in claim 10 wherein said gear engagement means is pivotally mounted with respect to said second pivot arm section to facilitate engagement and disengagement thereof with respect to said secondary gear rack.

16. An adjustable barrel tuning apparatus for use with a woodwind musical instrument as defined in claim 10 wherein said second pivot arm section is flexibly resilient to facilitate disengagement thereof from said secondary gear rack.

17. An adjustable barrel tuning apparatus for use with a woodwind musical instrument as defined in claim 1 further comprising a tactile indicator movably secured to said first tubular member and extending outwardly therefrom into abutting contact with said primary gear rack and being adapted to provide audible indication of increments of movement of said first tubular member with respect to said second tubular member, said tactile indicator including an indicator biasing means urging said tactile indicator into abutting contact with said primary gear rack.

18. An adjustable barrel tuning apparatus for use with a woodwind musical instrument comprising:

A. a first tubular member defining a first bore extending longitudinally and axially therethrough, said first tubular member defining a first bore upper end and a first bore lower end thereon, said first tubular member including an upper tubular member;

B. a second tubular member defining a second bore extending longitudinally and axially therethrough, said second tubular member being in movable engagement with said first tubular member to be telescopingly slidable with respect thereto, said first bore and said second bore being oriented with the longitudinally extending axes thereof being coincident, said second tubular member defining a second bore upper end and a second bore lower end thereon;

C. a primary gear rack fixedly secured to said second tubular member and extending longitudinally therealong;

D. an adjustment wheel rotatably mounted on said first tubular member, said adjustment wheel including two adjustment wheel members rotatably mounted to said first tubular member, said adjustment wheel further including a gear fixedly secured between said two adjustment wheel members and positioned in engagement with said primary gear rack, said adjustment wheel being responsive to rotational movement thereof to urge telescoping movement of said first tubular member axially and longitudinally with respect to said second tubular member to provide adjustability in tuning for a woodwind musical instrument by varying the spatial relationship between said first bore upper end and said second bore lower end;

E. a locking means positioned between said first tubular member and said second tubular member and adapted to detachably secure said first tubular member to said second tubular member to restrict relative movement therebetween, said locking means comprising:

(1) a locking slot defined between said first tubular member and said second tubular member and extending longitudinally therealong, said first tubular member being angularly tapered adjacent said locking slot;

(2) a locking slide member movably positioned within said locking slot and being slidable between a locking position wedged into simultaneous abutting contact with said first tubular member and said second tubular member and an unlocked positioned allowing relative movement between said first tubular member and said second tubular member, said locking slide member being slidable to a position adjacent said first tubular member adjacent the angularly tapered section thereof to facilitate wedging thereof into the locked position;

F. a first longitudinal orientation device fixedly attached to said first tubular member and comprising two key members extending longitudinally along said first tubular member;

G. a second longitudinal orientation device fixedly attached to said second tubular member and in engagement with said first longitudinal orientation device to restrict relative rotational movement of said first tubular member with respect to said second tubular member, said second longitudinal orientation device including a two key slots extending longitudinally along said second tubular member, said two key members and said two key slots being engageable with respect to one another to restrict rotational movement of said first tubular member with respect to said second tubular member;

H. a tactile indicator movably secured to said first tubular member and extending outwardly therefrom into abutment with said primary gear rack and being adapted to provide audible indication of increments of relative movement between said first tubular member and said second tubular member, said tactile indicator including an indicator biasing means urging said tactile indicator into abutment with said primary gear rack;

I. an extension limit means to restrict the maximum extend of movement of said first tubular member with respect to said second tubular member which comprises:

(1) a locking shoulder located on said first tubular member;

(2) a stepped slot defined in said second tubular member and adapted to receive said locking shoulder therein responsive to said key member of said first tubular member being moved within said key slot defined in said second tubular member to the fully extended position with said first bore upper end being positioned at the maximum required distance from said second bore lower end; and J. distance reference indicia positioned on said second tubular member adjacent said key member of said first tubular member to indicate the spatial distance between said first bore upper end of said first tubular member and said second bore lower end of said second tubular member and facilitate adjustment therebetween.

19. An adjustable barrel tuning apparatus for use with a woodwind musical instrument comprising:

A. a first tubular member defining a first bore extending longitudinally and axially therethrough, said first tubular member defining a first bore upper end and a first bore lower end thereon, said first tubular member including an upper tubular member;

B. a second tubular member defining a second bore extending longitudinally and axially therethrough, said second tubular member being in movable engagement with said first tubular member to be telescopingly slidable with respect thereto, said first bore and said second bore being oriented with the longitudinally extending axes thereof being coincident, said second tubular member defining a second bore upper end and a second bore lower end thereon, said second tubular member including a lower tubular member in moveable engagement with said upper tubular member, said first tubular member and said second tubular member being telescopingly slidable with respect to one another to provide adjustability in the distance between said first bore upper end and said second bore lower end and facilitate tuning of a woodwind musical instrument;

C. a primary gear rack fixedly secured to said second tubular member and extending longitudinally therealong;

D. a secondary gear rack fixedly secured to said second tubular member and extending longitudinally therealong, said second gear rack being positioned spatially distant from said primary gear rack;

E. an adjustment wheel rotatably mounted on said first tubular member, said adjustment wheel including two adjustment wheel members rotatably mounted to said first tubular member, said adjustment wheel further including a gear fixedly secured between said two adjustment wheel members and positioned in engagement with said primary gear rack, said adjustment wheel being responsive to rotational movement thereof to urge telescoping movement of said first tubular member axially and longitudinally with respect to said second tubular member to provide adjustability in tuning for a woodwind musical instrument by varying the spatial relationship between said first bore upper end and said second bore lower end;

F. a locking means positioned between said first tubular member and said second tubular member and adapted to detachably secure said first tubular member to said second tubular member to restrict relative movement therebetween, said locking means comprising;

(1) a pawl pivotally mounted on said first tubular member and being engageable with said secondary gear rack to selectively restrict movement of said first tubular member with respect to said second tubular member, said pawl comprising:

(a) a pivot arm pivotally mounted on said first tubular member, said pivot arm including a first pivot arm section and a second pivot arm section, said second pivot arm section being engageable with said secondary gear rack to restrict movement of said first tubular member with respect to said second tubular member, said second pivot arm section being flexibly resilient to facilitate engagement and release from engagement with said secondary gear rack;

(b) a gear engagement means mounted on said second pivot arm section, said gear engagement means being positionable adjacent said secondary gear rack for selective engagement therewith to restrict movement of said first tubular member with respect to said second tubular member; and (c) a release tab positioned on said first pivot arm section and being responsive to force being exerted thereagainst to pivot said pivot arm to move said gear engagement means out of engagement with said secondary gear rack and allow longitudinal axial movement of said first tubular member with respect to said second tubular member;

(2) a pawl biasing means attached to said pawl and said first tubular member and being adapted to urge said gear engagement means on said second pivot arm section of said pawl into engagement with said secondary gear rack, said pawl biasing means comprising a flat spring positioned between said pawl and said first tubular member;

G. a first longitudinal orientation device fixedly attached to said first tubular member and comprising two key members extending longitudinally along said first tubular member;

H. a second longitudinal orientation device fixedly attached to said second tubular member and in engagement with said first longitudinal orientation device to restrict relative rotational movement between said first tubular member and said second tubular member, said second longitudinal orientation device including a two key slots extending longitudinally along said second tubular member, said two key members and said two key slots being engageable with one another to restrict rotational movement of said first tubular member with respect to said second tubular member;

I. a tactile indicator movably secured to said first tubular member and extending outwardly therefrom into abutting contact with said primary gear rack and being adapted to provide audible indication of increments of movement of said first tubular member with respect to said second tubular member, said tactile indicator including an indicator biasing means urging said tactile indicator into abutting contact with said primary gear rack;

J. an extension limit means to restrict the maximum extend of movement of said first tubular member with respect to said second tubular member which comprises:

(1) a locking shoulder located on said first tubular member;

(2) a stepped slot defined in said second tubular member and adapted to receive said locking shoulder therein responsive to said key member of said first tubular member being moved within said key slot defined in said second tubular member to the fully extended position with said first bore upper end being positioned at the maximum required distance from said second bore lower end; and K. distance reference indicia positioned on said second tubular member adjacent said key member of said first tubular member to indicate the spatial distance between said first bore upper end of said first tubular member and said second bore lower end of said second tubular member and facilitate adjustment therebetween.

* * * * *